United States Patent [19]

Levental

[11] Patent Number: 4,535,324

[45] Date of Patent: Aug. 13, 1985

[54] REMOTE ACTIVATED ALARM TRIGGERING DEVICE

[76] Inventor: Mark Levental, 7925 Kingsley Rd., No. 811, Cote St. Luc, Montreal, Quebec, Canada, H4W 1P5

[21] Appl. No.: 397,538

[22] Filed: Jul. 12, 1982

[51] Int. Cl.[3] ..... G08B 13/02

[52] U.S. Cl. ..... 340/574; 340/531; 340/539

[58] Field of Search ..... 340/531, 539, 574; 200/DIG. 2, 61.58 R, 52 R

[56] References Cited

U.S. PATENT DOCUMENTS 2,516,180 7/1950 Brown ..... 200/DIG. 2

3,825,833 7/1974 Bogue et al. ..... 340/574 X

*Primary Examiner*—Glen R. Swann, III

[57] ABSTRACT

An alarm activator in the form of a ring-transmitter can be squeezed readily to activate an alarm by either ultrasonic or radio or infrared waves. The ring consists of either an ultrasonic or radio or infrared transmitter in a casing welded on an incomplete ring. Inside the casing is located a power source, a time delay circuit, an oscillator, a timer and either an ultrasonic or radio or infrared transducer. The tips of the incomplete ring are provided with two conductors, e.g. silver plates, one on each tip, forming a normally open contact. An all-around clearance is provided between the casing and the ring to permit the compression of the ring without interference from the casing to close the normally open contact and to permit current to flow from the power source through the time delay, energizing the timer which in turn will turn on the oscillator for a short time. The oscillator energizes the transducer which generates either ultrasonic, radio or infrared waves, and upon reaching a receiver an alarm will be initiated.

12 Claims, 4 Drawing Figures

REMOTE ACTIVATED ALARM TRIGGERING DEVICE

BACKGROUND OF THE INVENTION

This invention relates to a finger ring transmitter for initiating a remote alarm.

Ever since man has started trading, theft has been a major problem, reappearing throughout the ages and showing us its ugly face. Development of devices providing security for the dealer or teller as well as security for the transaction itself where items of value are being transferred or held by the dealer or teller and the agency he represents, has been a continuing concern which has assumed increased significance with the passing years. Attempted means for providing an adequate degree of protection have assumed a variety of forms. Most such security devices are conceived for use by banks and similar institutions which are seen generally to yield the richest and most readily convertible rewards to those intent on appropriation of value by physical force or thread of physical force. Accordingly, and for the convenience, most of the discussion appearing herein will be in terms of banks. It will, of course, be obvious that the present invention has application, however, to trust companies, jewelry stores, art galleries, prisons (to alert of any uprising), warehouses, shops, showrooms or any other place where property and, or transactions have to be protected without endangering human lives.

SUMMARY OF THE INVENTION

It is accordingly, an object of this invention to provide a system to alert the police as soon as a robbery starts to unfold, which includes either an ultrasonic or radio or infrared transmitter mounted on a ring, said ring to be worn by the manager of the bank, his assistant or any other employee, and a receiver placed anywhere in the surrounding area, said receiver actuating the alarm at a police station.

A particular object of the invention is to provide greater security for the bank manager and the tellers, who are usually in danger of being suspected of trying to activate an alarm. This invention bypasses these dangers by being inconspicuous, compact, mobile, reliable and the fact that it can be activated from any position, even if handcuffed, lying on the floor with one's hands up, even in close proximity of the robbers. As well, it cannot generate suspicions among the robbers who will never suspect that the ring can trigger an alarm.

According to the invention there is provided either an ultrasonic or radio or infrared transmitter in a casing welded on an incomplete ring, the casing containing a power source, a time delay, an oscillator, a timer, and either an ultrasonic or radio or infrared transducer, the tips of the incomplete ring being soldered to two conductors, in this case silver plates, one on each tip, forming a normally open contact, an all-around clearance between the casing and the ring to permit the compression of the ring without interference from the casing to close the normally open contact and to permit current to flow from the power source through the time delay, energizing the timer which in turn will turn on the oscillator for a short time, the oscillator energizing the transmitter, which will generate either ultrasonic or radio or infrared waves, said waves upon reaching a receiver being turned into corresponding electrical impulses, the impulses being filtered by a bandpass filter to eliminate surrounding interference and to make sure that only the chosen frequency can activate an alarm.

BRIEF DESCRIPTION OF THE DRAWINGS

A preferred embodiment of the present invention will now be described with reference to an example thereof as illustrated in the accompanying drawings, in which.

DETAILED DESCRIPTION OF THE PREFERRED EMBODIMENT

It is common in devices for activating alarms to have a switch e.g. a push-button or a pedal situated on the floor, on a wall or under the counter. When an emergency arises the teller presses the button or the pedal to activate the alarm. This procedure, in my opinion, is awkward as well as dangerous. When confronted by a robber with a firearm the teller is limited as to the movements he or she can do without raising suspicions and being shot at. The button being immobile makes it impossible to actuate the alarm when the teller is too far away and cannot reach it. And since every movement is prohibited, standing even close to the button makes it hard, risky and dangerous to activate the alarm. Moreover, if the teller is instructed to stand or lie in the center of the room, the chances of alerting the police are null.

My invention bypasses all these inconveniences by being independent of any wires and thus being portable. It consists of a transmitter mounted on a ring. This ring is to be worn by the bank manager, his assistant or other employees. The transmitter can be activated by squeezing the ring with two adjacent fingers. The transmitter will have a time delay of 0.1–5.0 seconds, which means that the squeeze will have to be maintained for at least 0.1 seconds uninterruptedly in order to turn the transmitter on. This delay will insure the person from turning on the transmitter inadvertently. The transmitter will turn itself off after 0.1–20.0 seconds. The transmitter will be housed in a casing and consist of:

(a) power source
(b) oscillator
(c) time delay
(d) ultrasonic or radio or infrared transducer
(e) normally open contact
(f) timer During a hold-up the person, who will be wearing the ring-transmitter, will squeeze the ring with his two adjacent fingers, and thus turn on the transmitter. A receiver will be placed anywhere in the room. Other receivers could be installed in other rooms such as the manager's office. The waves, either ultrasonic or radio or infrared, from the transmitter will propagate throughout the room and upon reaching the receiver will activate the alarm at a police station.

Figure 1A:
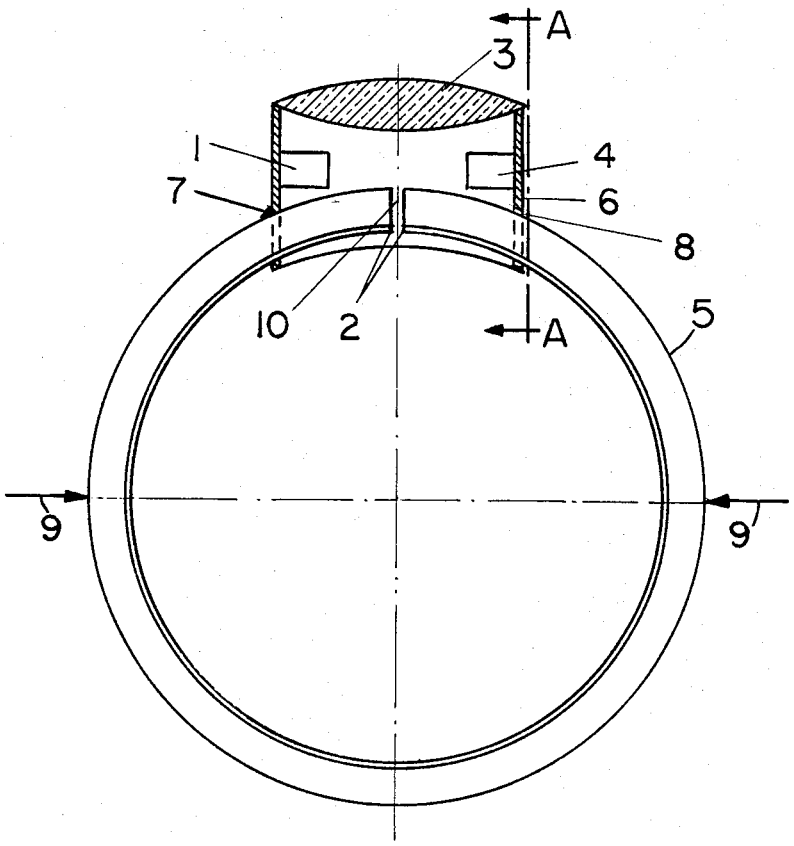
FIG. 1A is a side view of the ring and cross section of the casing containing the transmitter embodying the present invention.
Figure 1B:
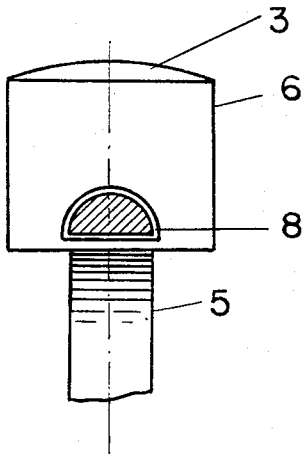
FIG. 1B is a section view as seen in the direction of section lines A—A in FIG. 1A and illustrating the all-around gap.

The device illustrated in FIG. 1 comprises an incomplete ring 5 to which the casing 6 is welded at a point 7. To the tips of the incomplete ring will be soldered two conductors 2, in this case silver plates, one on each tip, to form a normally open contact 10. The gap between the silver contacts is between 0.1–3.0 millimeters wide. There shall exist an all-around clearance 8 between the casing and the ring (FIG. 1B) to permit the compression of the ring without interference from the casing. The clearance will be between 0.1 and 3.0 millimeters wide. Casing 6 will contain a power source 1, 12 a timer, a time delay circuit 11, and an oscillator 13 forming part of the transmitter, as later described. The wearer's fingers will supply opposed transverse forces in the direction of arrows 9. The cover of the casing be formed by a transducer 3 which may be either an ultrasonic, in which case it would be a piezoelectric crystal, or radio or infrared transducer.

Figure 2:
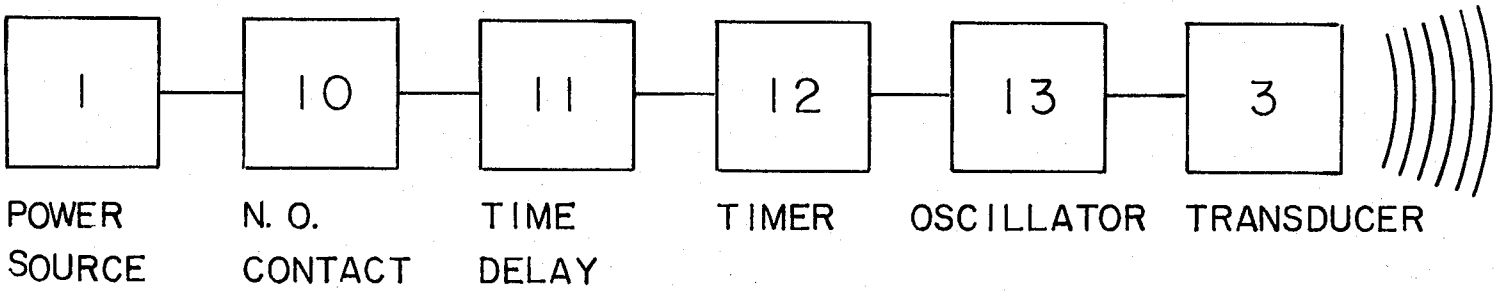
FIG. 2 is a block diagram of the transmitter.

The block diagram of the transmitter, illustrated in FIG. 2, consists of power source 1 connected to a normally open contact 10 which connects to a time delay circuit 11 which in turn connects to a timer 12 feeding an oscillator 13 connected to either an ultrasonic or radio or infrared transducer 3.

Figure 3:
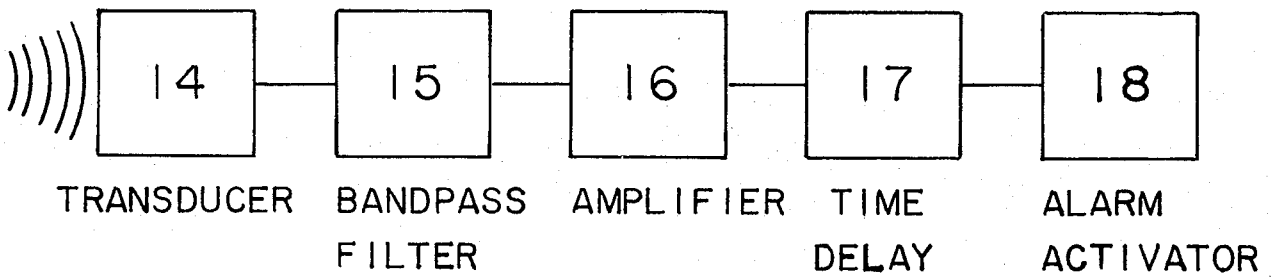
FIG. 3 is a block diagram of the receiver.

The block diagram of the receiver, illustrated in FIG. 3, consists of transducer 14 14 connected to a band-pass filter 15 which feeds an amplifier 16 connected to a time delay circuit 17 which feeds an alarm activator 18.

In an emergency, the person wearing the ring illustrated in FIG. 1 will squeeze with his two adjacent fingers, supplying forces 9 which in turn will close the normally open contact 10 (FIG. 1 or 2). Current will then flow from power source 1 (FIG. 2) through time delay 11, set for 0.1 to 5.0 seconds, energizing the timer 12 which in turn will turn on the oscillator 13 for 0.1 to 20.0 seconds. The oscillator 13 energizes either the ultrasonic or radio or infrared transducer 3, which will generate respectively either ultrasonic or radio or infrared waves.

The generated waves upon reaching the transducer 14 of the receivers (FIG. 3) will be turned into corresponding electrical impulses. These impulses will be filtered by the band-pass filter 15 to eliminate surrounding interference. This filter will make sure that only the chosen frequency can activate the alarm. The electrical impulses having passed the filter will be amplified by the amplifier 16 and fed to the alarm activator 18 through time delay 17. This time delay will make sure that only the ring can activate the alarm, since in order to activate the alarm, the time delay will have to be fed a signal uninterruptedly for at least 0.01 to 5.00 seconds.

The embodiments of the invention in which an exclusive property or privelege is claimed are defined as follows:

1. A remotely activated alarm triggering device comprising a transmitter means mounted in a casing which is secured to an incomplete finger ring, said ring having opposed free ends forming a gap, an electrical conductor secured to each of said opposed free ends, said gap forming a normally open contact, said normally open contact being closed by applying opposing forces on said ring by fingers adjacent said ring when worn to close the normally open contact whereby to activate said transmitter to generate a signal to activate a remote alarm circuit.

2. A remotely activated alarm triggering device as defined in claim 1, wherein said transmitter means is an ultrasonic frequency transmitter; said transmitter including a power source, a time delay circuit, an oscillator, a timer and an ultrasonic sound generator; said normally open contact when closed permitting current to flow from said power source through said time delay circuit energizing said timer which turns on the oscillator for a short time, said oscillator energizing said ultrasonic sound generator which generates ultrasonic sound waves to activate said alarm circuit, wherein said alarm circuit is a receiver comprising a transducer which will convert said generated sound waves into corresponding electrical impulses, said impulses being filtered by a band-pass filter to eliminate surrounding interference, and to make sure that only a predetermined frequency can activate an alarm, said electrical impulses, having passed said filter, being amplified by an amplifier and fed to an alarm activator through a time delay circuit.

3. A remotely activated alarm triggering device as defined in claim 2, in which said casing is welded to said ring adjacent one of said opposed free ends and extends across said gap, said casing also having an all-around clearance between the casing and the ring to permit said gap to be closed without interference from said casing.

4. A remotely activated alarm triggering device as defined in claim 3, in which said clearance is between 0.1 and 3.0 millimeters wide.

5. A remotely activated alarm triggering device as defined in claim 2, in which said conductors are silver plates mounted on the free ends of the ring to form said normally open contact.

6. A remotely activated alarm triggering device as defined in claim 5, in which said gap between said conductors is between 0.1 and 3.0 millimeters wide.

7. A remotely activated alarm triggering device as defined in claim 2, in which said ultrasonic sound generator is a piezoelectric crystal.

8. A remotely activated alarm triggering device as defined in claim 2, in which said time delay circuit of said transmitter provides a time delay of between 0.1 and 5 seconds.

9. A remotely activated alarm triggering device as defined in claim 2, in which said timer will automatically turn off said transmitter after a delay of 0.1–20 seconds.

10. A remotely activated alarm triggering device as defined in claim 2, in which said time delay circuit of receiver provides a delay of between 0.01 and 5 seconds.

11. A remotely activated alarm triggering device as claimed in claim 1, wherein said transmitter means is a radio transmitter which generates radio frequency waves.

12. A remotely activated alarm triggering device as claimed in claim 1, wherein said transmitter means is an infrared transmitter generating infrared frequency waves.

* * * * *